US011091315B2

(12) United States Patent
Mercier

(10) Patent No.: US 11,091,315 B2
(45) Date of Patent: Aug. 17, 2021

(54) CAPSULE FOR BEVERAGE PREPARATION MACHINE

(71) Applicant: NESTEC S.A., Vevey (CH)

(72) Inventor: Marion Sylvie Suzanne Mercier, Lausanne (CH)

(73) Assignee: Societe des Produits Nestle S.A., Vevey (CH)

( * ) Notice: Subject to any disclaimer, the term of this patent is extended or adjusted under 35 U.S.C. 154(b) by 149 days.

(21) Appl. No.: 16/311,388

(22) PCT Filed: Jun. 23, 2017

(86) PCT No.: PCT/EP2017/065574
§ 371 (c)(1),
(2) Date: Dec. 19, 2018

(87) PCT Pub. No.: WO2018/001903
PCT Pub. Date: Jan. 4, 2018

(65) Prior Publication Data

US 2019/0233200 A1 Aug. 1, 2019

(30) Foreign Application Priority Data

Jun. 28, 2016 (EP) ..... 16176539

(51) Int. Cl.
*B65D 85/80* (2006.01)
*B65D 85/804* (2006.01)

(52) U.S. Cl.
CPC ..... *B65D 85/8043* (2013.01)

(58) Field of Classification Search
CPC ..... B65D 85/8043; B65D 85/804; B65D 85/8046; A47J 31/407
See application file for complete search history.

(56) References Cited

U.S. PATENT DOCUMENTS

2009/0211458 A1* 8/2009 Denisart ..... B65D 85/8043 99/300
2012/0070542 A1* 3/2012 Camera ..... B65D 85/8043 426/77
2014/0053735 A1* 2/2014 Verbeek ..... A47J 31/3676 99/295

(Continued)

FOREIGN PATENT DOCUMENTS

CN 102099261 A 6/2011
CN 104619608 A 5/2015

(Continued)

*Primary Examiner* — Ericson M Lachica
(74) *Attorney, Agent, or Firm* — K&L Gates LLP

(57) ABSTRACT

A beverage capsule (100) comprises a capsule body (102) defining a cavity (104) and comprising a first end face (106) cooperating with the water injecting means (206) of a beverage-preparation apparatus (200), and further comprises a cup-shaped partition (114) extending into said cavity (104) from a second end face (116) of said capsule body (102) opposite said first end face (106), forming a space (118) between the partition (114) and first end face (106), and a chamber (117) within the partition (114) in which a quantity of a beverage ingredient (120) is disposed, a fluid communication means (126) establishing fluid communication across said partition (114).

12 Claims, 1 Drawing Sheet

(56) References Cited

U.S. PATENT DOCUMENTS

| | | | | |
|---|---|---|---|---|
| 2014/0161940 | A1* | 6/2014 | Aviles | B65D 81/3238 426/115 |
| 2014/0170271 | A1* | 6/2014 | Zweed | B65D 85/8043 426/115 |
| 2014/0272018 | A1* | 9/2014 | Koller | B65D 85/8043 426/115 |
| 2016/0244237 | A1* | 8/2016 | Hentzel | B65D 3/24 |
| 2018/0093821 | A1* | 4/2018 | Cabilli | B65D 65/466 |

FOREIGN PATENT DOCUMENTS

| | | |
|---|---|---|
| WO | 2011159162 | 12/2011 |
| WO | 2013132436 | 9/2013 |
| WO | 2015008309 | 1/2015 |

* cited by examiner

CAPSULE FOR BEVERAGE PREPARATION MACHINE

CROSS REFERENCE TO RELATED APPLICATIONS

The present application is a National Stage of International Application No. PCT/EP2017/065574, filed on Jun. 23, 2017, which claims priority to European Application No. 16176539.1, filed on Jun. 28, 2016, the entire contents of which are being incorporated herein by reference.

FIELD OF THE INVENTION

The present invention concerns a capsule for a beverage-preparation machine. The present invention also concerns an apparatus for breaching such a capsule, as well as a kit comprising said apparatus and at least one such capsule.

BACKGROUND OF THE INVENTION

Single-serving beverage preparation machines are well known in the food industry and consumer goods domain. Such machines allow a consumer to prepare on command a single serving of a beverage such as drip coffee, espresso coffee, tea, hot chocolate drink, or even liquid foodstuffs such as soup or infant formula.

Most beverage preparation machines for in-home use operate according to a system in which beverage ingredients are provided in single-serving portions in individual containers, in particular in the form of a rigid or semi-rigid capsule. Such capsules are ordinarily (but not necessarily) hermetically sealed, so as to maintain the freshness and quality of the beverage ingredient within the capsule until use.

To prepare a serving of a beverage, the capsule is first inserted into a beverage preparation machine adapted to receive it. The beverage preparation machine comprises a means for heating a volume of water and conducting it into the beverage capsule, wherein the heated water combines with the beverage ingredient to make a beverage.

The means of the beverage preparation machine which are adapted to receive the beverage capsule may take various forms, but in general will contain a receptacle adapted to the form of the capsule in question; and an injection unit which comprises an injection needle and is positioned upon the beverage capsule.

The water may be injected at an elevated pressure (for e.g. espresso coffee), or simply made to flow into the capsule at atmospheric pressure (for e.g. drip coffee or soluble beverage ingredients). Where the capsule is provided in a hermetically-sealed form, the beverage preparation machine may advantageously be provided with a hollow injection needle, which is used to both break the hermetic seal of the capsule and to inject the heated water to produce the beverage.

Once prepared, the beverage is dispensed from the capsule into a waiting container for consumption. To maintain the hermetic seal of the capsule, the outlet of the capsule is maintained in a sealed state until the beverage preparation process is begun, at which point the capsule is opened to allow the water to be injected into and the beverage to flow out of the capsule. This is advantageously accomplished by constructing the beverage capsule of a frangible material, and/or providing a frangible membrane on a surface of the beverage capsule adapted to be pierced by the injection needle.

However, the beverage capsules known in the art are disadvantageous, in that most beverage ingredients (in particular those provided in the form of a granulated or fine particulate, such as ground coffee) will tend to form "channeled flow" when the water is injected. By channeled flow, it is meant that the water flowing through the ingredient will naturally favour a certain path, leaving the rest of the volume of beverage ingredient under-extracted.

This is frequently exacerbated by the injection of the water into the capsule by way of the injection needle, as the thin stream issuing from said needle will churn up the beverage ingredient and induce or exacerbate such channeled flow. Diffuser elements may be employed to mitigate this, but such devices add to the weight, complexity, and cost of beverage capsules which incorporate them.

As a result, the beverage capsules must be made larger and contain more beverage ingredient than is strictly necessary, so as to compensate for this channeled flow and provide a beverage of acceptable quality.

There is thus a need for a beverage capsule which resolves at least partially these disadvantages.

SUMMARY OF THE INVENTION

To this end, the invention is directed in a first aspect towards a capsule for a beverage-preparation apparatus, comprising a substantially cup-shaped capsule body defining a cavity and comprising a first end face adapted to cooperate with a water injecting means of said beverage-preparation apparatus.

According to the invention, said capsule further comprises a substantially cup-shaped partition extending into said cavity from a second end face of said capsule body opposite said first end face, a space being thereby formed between said partition and said first end face, said partition defining with said second end face a chamber within which a quantity of a beverage ingredient is disposed; and a fluid communication means disposed in and establishing fluid communication across said partition.

A capsule so configured is advantageous in that the provision of the partition greatly simplifies the control of the fluid being injected into the capsule.

Specifically, by placing the partition between the first end face wherein the water is injected, and the beverage ingredient, the flow of the water across the partition and thus into and through the beverage ingredient can be finely controlled by controlling the size, shape, quantity, and position of the at least one channel disposed in the partition.

As a result, a uniform "plug" flow (i.e. where the velocity of the water flow is constant across any cross-section perpendicular to the direction of flow) of the water into the chamber and through the beverage ingredient can be achieved, avoiding the creation of a channeled flow and the consequent irregular, lower-quality beverage extraction.

Moreover, the interposition of the partition as described above will prevent the water from being directly incident upon the beverage ingredient as it is injected into the capsule, thereby avoiding the beverage ingredient from being broken up under the jet of water as it is injected, and channel flow being induced as a result.

In this way, the quality and consistency of the extraction of the beverage is improved. Moreover, as a result of the greater control exerted over the flow of the water, the beverage-preparation process is made more efficient, and the quantity of beverage ingredient in each capsule may be consequently reduced.

The construction of the capsule is also greatly simplified relative to those found in the art, in that it only comprises one-or-two components, along with any sealing membranes.

In a possible embodiment, the chamber communicates with an opening in the second end face of the capsule, a membrane being sealed to said opening.

A beverage capsule so configured is advantageous in that by sealing the opening in the second end with a simple membrane, the fabrication and loading of the capsule with the beverage ingredient is greatly simplified.

In particular, the provision of the second membrane permits the filling of the beverage capsule from the second end face, i.e. the bottom of the capsule. Thus, the beverage ingredient can be filled without worrying about accidentally fracturing one of the membranes on the capsule, as the partition will protect the membrane on the first end face, and the second membrane is attached after the filling is complete.

In a preferred embodiment, the beverage ingredient is compressed into the chamber defined by the partition.

This is advantageous in that the compressed mass of beverage ingredient will be naturally conducive to the uniform flow of water through it, thereby producing a higher quality beverage with less beverage ingredient per unit volume of beverage than the systems known in the art wherein such uniform flow cannot be assured.

In a possible embodiment, the fluid communication means is disposed in the partition proximate to the first end face and opposite the second end face of the beverage capsule.

This is advantageous in that the water entering the chamber and mixing with the beverage ingredient to create the beverage will have to travel the entire height of the chamber before it is drained through the opening in the second end face. In this way, a more thorough extraction is achieved, producing a higher-quality beverage.

Preferably, the fluid communication means is constituted by a plurality of perforations uniformly distributed across a surface of the partition.

In this way, the penetration of the water into the chamber, and thus into the beverage ingredient, is made both more diffuse and more uniform. The quality of the beverage extraction is thereby improved.

In a possible embodiment, the partition is disposed centrally within the capsule body, an annular gutter being formed between the partition and the capsule body.

This is advantageous in that the when the water is injected into the beverage capsule, the gutter will fill first before the water reaches the level of the at least one channel in the partition, at which point it will then flow into the chamber and mix with the beverage ingredient to make the beverage. Thus, the high-pressure stream of water injected into the capsule is broken up without the need for a diffuser plate or other such structure.

Also, the presence of the gutter will help to maintain the structural integrity of the partition when the beverage capsule is pressurized, by equalizing the pressure across the partition. Thus, disturbance to the beverage ingredient in the chamber, and any resultant channeled flow through it, is minimized. At the same time, the partition may be made thinner in that the pressure differential it must support is reduced.

Moreover, the gutter will naturally retain the excess water at the end of the beverage preparation process, reducing dripping from the capsule as it is removed from the beverage preparation machine for disposal.

In a possible embodiment, the partition has a cylindrical or frusto-conical form.

Such a form is advantageous in that it is generally simple to manufacture, and facilitates the configuration of the capsule body so as to be stackable, while still retaining a considerable degree of structural strength, particularly in compression.

Moreover, the provision of the partition facilitates the compression of the beverage ingredient in that it provides a face against which the beverage ingredient can be compressed, particularly in cooperation with an anvil or other such structure temporarily positioned against said face such that the force of a tamper can be brought to bear without deforming the capsule body.

In a possible embodiment, the volume of the chamber is between 10 $cm^3$ and 15 $cm^3$, and preferably 12 $cm^3$.

A beverage capsule so configured is advantageous in that such a range of chamber volumes is suitable to produce a wide range of beverages from a wide range of beverage ingredients, notably ground roasted coffee.

In a possible embodiment, the capsule body and partition are formed as a single piece.

This is advantageous in that the beverage capsule is produced in a minimum number of operations, thereby reducing its cost and time of fabrication.

In another possible embodiment, the capsule body and partition are formed separately and assembled together.

In this way, the beverage capsule may employ a much greater degree of flexibility in the configuration and materials employed in its construction.

According to a second aspect, there is provided a breaching element comprising at least one projection, said breaching element being adapted to be disposed in a capsule receptacle adjacent to a capsule according to any one of the preceding claims, such that upon the injection of a volume of water into the capsule the second end face of said capsule is deflected into and ruptured by said at least one projection of said breaching element.

This is advantageous in that the beverage capsule as described above may be used in a beverage-preparation apparatus which may not otherwise be suitable for it. In particular, the provision of the breaching element allows the capsules according to the invention to be utilized in systems designed for beverage capsules where the second end face is opened manually, or which comprise a breaching means integrated into the capsule itself. The breaching element is an element, or a plurality of elements which is/are raised element(s) relatively to a corresponding recess, or series of recesses. The raised and recessed elements provide the surface of the capsule receptacle has a non-flat surface. When the second-end face of the capsule deflects under pressure, its surface conforms mechanically to the uneven surface created by the raised and recessed elements. In order to change its state from a substantially flat surface into an uneven surface, the material of the second-end face of the capsule is stretched until it reaches its maximum stretch point and tears open.

Alternatively, or simultaneously to the above described opening mechanism, the second-end face of the capsule can be also more directly punctured by a sharp profile of the raised and/or recessed breaching elements.

Moreover, a breaching element provided separately from the beverage capsule with which it cooperates is advantageous in that it may be made mechanically more stable than a similar element that is incorporated into the structure of the beverage capsule, thereby improving its reliability.

In this way, the advantages of the beverage capsule according to the present invention may be enjoyed in a wider variety of applications and with a minimum of additional cost.

In a possible embodiment, the breaching element is adapted to attach to the beverage capsule.

In this way, the capsule is provided with its own breaching element, without the added cost or complication of integrating such into the capsule itself.

The breaching element may be permanently attached to the beverage capsule during manufacture, or removable so that the user may replace it periodically, such as when switching from one kind of beverage to another, or clean it between uses.

Preferably, the breaching element further comprises at least one channel adapted to direct the flow of a beverage issuing from the beverage capsule.

This is advantageous in that the flow of the beverage within the beverage preparation machine is better controlled, thereby improving both the quality of the drinks produced and the cleanliness of their production.

Preferably, the breaching element further comprises a plurality of pyramidal projections.

This is advantageous in that it will effectively breach the beverage capsule during use, without presenting a surface which is so sharp as to cause injury should the user accidentally touch it.

Moreover, the pyramid plate will create a plurality of openings in the capsule, thereby improving the flow from said capsule and giving a greater degree of control over the extraction of the beverage.

Also, the use of a pyramid plate is advantageous in that the dimensions and variation in the pyramidal projections are very easily controlled during manufacture, allowing the user to manufacture a breaching element with a great degree of precision without a great deal of additional effort or expenditure.

According to a third aspect, there is provided a kit comprising at least one capsule as described above, and a breaching element as described above.

This is advantageous in that it provides the beverage capsule along with the breaching plate in one package, allowing the user to realize the advantages of both in a simple and convenient package.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
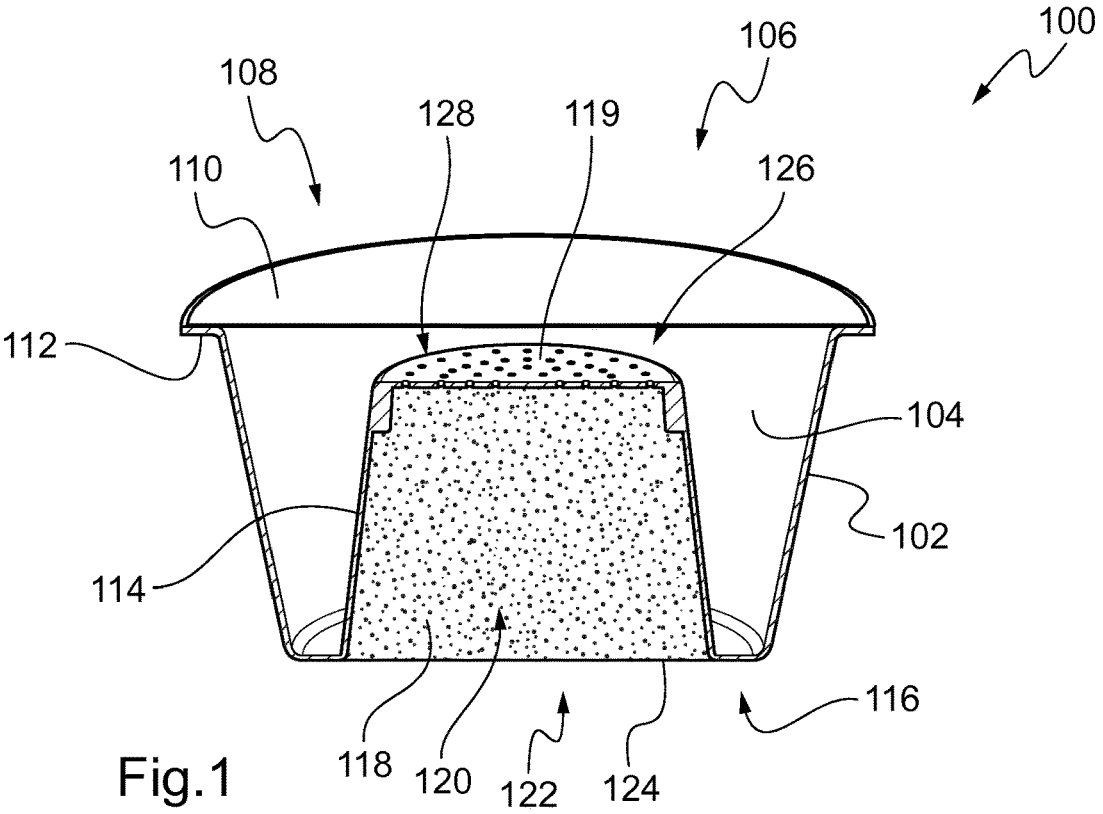
FIG. 1 is a cross-sectional view of a beverage capsule according to an embodiment of the invention.

Turning now to the figures, the invention will be illustrated with reference first to the embodiment depicted in FIG. 1.

A beverage capsule 100 according to the invention comprises a capsule body 102. The capsule body 102 is a substantially cup-shaped structure, and as such encloses a cavity 104.

The capsule body 102 may exhibit a great deal of variation in size, shape, and proportion, according to the particular needs of the application in which it is to be employed. In the embodiment depicted in FIG. 1, for instance, it is generally in the shape of an inverted frustum of a cone. However, other shapes, such as cylinders, hemispheres, or more complex forms, may be envisioned in other applications.

A first end face 106 of the beverage capsule 100 comprises a first opening 108, through which the cavity 104 communicates with the environment. A first membrane 110 is disposed upon the first opening 108 to seal it; for instance, in the embodiment depicted in FIG. 1, the first membrane 110 is sealed to a rim 112 over the entire circumference thereof.

The beverage capsule 100 further comprises a partition 114. The partition 114 extends from a second end face 116 of the beverage capsule, opposite the first end face 106. The partition 114 extends from the second end face 116 towards the first end face 106, such that it encloses a portion of the cavity 104, here represented by a chamber 117.

It will be noted that while the partition 114 extends towards the first end face 106, it does not extend across the entire height of the cavity 104. There is thus a space 118 formed between a face 119 of the partition 114 proximate to the first end face 106 and the first end face 106 itself.

As a result, water injected into the cavity 104 through the first membrane 110 will necessarily enter into the part of the cavity 104 which is not also within the chamber 117, passing through the space 118 between the partition 114 and the first end face 116 before it can enter the chamber 117 according to the manner described below.

The chamber 117 is thus defined as a certain portion of the volume of the cavity 104, and is separated therefrom by the partition 114. In the chamber 117 is disposed a quantity of a beverage ingredient 120.

By "beverage ingredient" it should be understood that many different beverage ingredients, precursors, or components may be envisioned, and that a beverage capsule according to the present invention is not necessarily limited to any one kind. For instance, ground coffee, freeze-dried coffee, dried tea leaves, powdered milk, cocoa, sugar, or any combination of these may be envisioned. Other food products may also be appropriate, such as powdered infant formula or freeze-dried soup broth.

The volume of the chamber 117 will depend at least in part on the type of beverage ingredient to be packaged therein. However, for most consumer applications, a chamber volume between 10 $cm^3$ and 15 $cm^3$ is appropriate; 12 $cm^3$ in particular is desirable in that it is appropriate for packaging a dose of ground, roasted coffee sufficient for extracting one serving of drink.

It should be noted that the substantially cup-shaped form of the partition will permit the beverage ingredient to be compressed into the chamber. For instance, to load the beverage ingredient 120 into the beverage capsule 100, the manufacturer need only invert the capsule body 102, dispense the correct amount of beverage ingredient into the chamber 117, and compress it against the partition by e.g. a tamping device. The partition 114 provides a structure which facilitates the positioning of the capsule body 102 in a compression device, for instance a tamper to compress the beverage ingredient and an anvil, disposed against the partition 114 opposite the beverage ingredient, against which the tamper presses. In this way, the risk of deforming or otherwise damaging the structure of the beverage capsule 100 is reduced.

This avoids the problems encountered in the beverage capsules known in the art, wherein attempting to compress the beverage ingredient into the beverage capsule can damage the structure of the capsule, in particular causing the membranes sealing the openings of the beverage capsule to deform or even prematurely rupture.

The second end face 116 also comprises a second opening 122, through which the chamber 117 communicates with the environment, and a second membrane 124 is sealed to said second opening 122 to fully enclose the chamber 117.

In the embodiment depicted in FIG. 1 the second opening 122 extends over the entire part of the second end face 116 that is within the partition 114. However, this need not necessarily be the case; in other embodiments, it may be desirable to configure the second opening differently, or even provide the second opening as a collection of smaller apertures.

It will be noted that the partition 114 is, in the embodiment depicted in FIG. 1, provided in the form of a frustum of a cone. However, it may be desirable to provide the partition in other forms for other implementations, for instance in the form of a cylindrical, hemispherical, or other regular three-dimensional geometric form, or even in an irregular three-dimensional form.

It should be evident that, in order to produce a beverage using the beverage capsule 100, there must be some means for introducing a volume of water into the capsule and causing it to mix with the beverage ingredient 120 to produce a beverage.

To this effect, the partition 114 is provided with a fluid communication means 126 which establishes fluid communication across the partition 114, between the portion of the cavity 104 that is not enclosed by the partition 114 (i.e. not comprising the chamber 117) and the portion of the cavity 104 that is enclosed by the partition 114 (i.e. comprising the chamber 117).

In this way, a water that is injected into the capsule by conventional means (for instance, through a hollow needle used to pierce the first membrane 110, as depicted in FIG. 3 and described infra in reference thereto), can flow through to the beverage ingredient that is enclosed within the chamber by the partition.

In the embodiment depicted in FIG. 1, the fluid communication means 126 is constituted by a plurality of perforations 128, which are uniformly distributed across a face 119 of the partition 114 proximate to the first end face 106.

This is particularly advantageous for a number of reasons. First, the small area of each individual one of the perforations 128 will serve to diffuse the flow of the water across the partition 114.

Moreover, since the perforations 128, by virtue of their small size, will serve to restrict the flow of water across the partition 114, the pressure of the water flowing through the beverage ingredient 120 in the chamber 117 can be controlled to an additional degree; this will serve to moderate variations in the pressure at which the water is injected into the capsule 100 and yield a more consistent beverage quality.

Thus, a simple control of the pressure at which the water flows through the beverage ingredient 120 can be achieved, without otherwise modifying or adjusting the beverage preparation machine. This is advantageous in that one type of beverage capsule 100 may be adapted for many different kinds of beverage ingredients which are not necessarily extracted at the same pressure.

Finally, the placement of the perforations 128 across the face 119 in a uniform distribution contributes to an even rate of flow of the water over the cross-section of the chamber 117. This results in a substantially-uniform, non-tubular flow of the water through the chamber 117 and the beverage ingredient 120, the so-called "plug flow" that has a minimal degree of turbulence and variation as a result of its substantially flat velocity flow profile.

It should be noted that, depending on the form of the capsule body and the partition, different methods for fabricating the beverage capsule may be employed.

For instance, the partition and the capsule body may be formed as a single unit, such as by injection moulding. This is particularly advantageous when the partition and the beverage capsule have reasonably simple geometries, and is conducive to high-speed, high-volume automated production.

Alternatively, it may be advantageous to form the partition and the capsule body separately, and then assemble them together during the fabrication of the beverage capsule by mechanical, chemical, thermal, or other bonding means. This may be particularly advantageous where the partition and the capsule body have complex forms which do not easily lend themselves to unitary fabrication processes, where different materials are employed for these two components, or for other reasons that preclude unitary fabrication.

Figure 2:
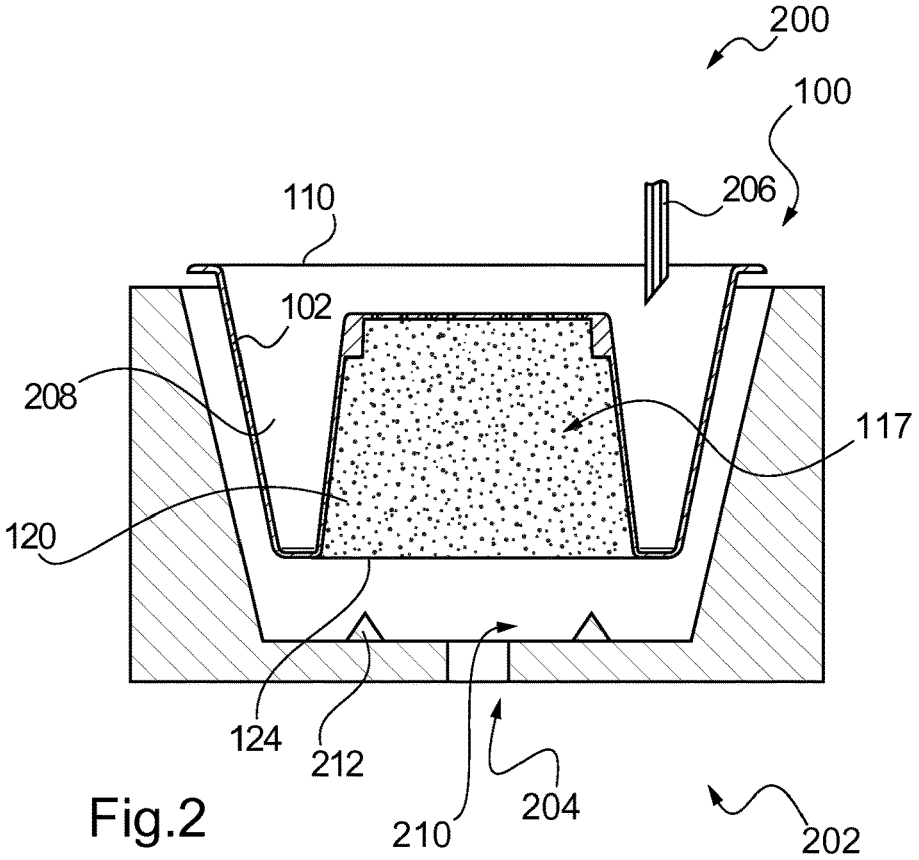
FIG. 2 is a cross-sectional view of a beverage capsule according to the embodiment of FIG. 1 and a breaching element according to an embodiment of the invention, as disposed in a capsule receptacle of a beverage preparation machine.

Turning now to FIG. 2, there is depicted a beverage capsule 100 disposed in an exemplary beverage preparation apparatus 200.

The beverage preparation apparatus 200 comprises a capsule receptacle 202, which is adapted to receive a beverage capsule such as the beverage capsule 100. The capsule receptacle comprises a drain hole 204, which permits the beverage to flow from the beverage capsule 100 and into a waiting container for consumption.

It will of course be recognized that the capsule receptacle 202 depicted here is merely one possible embodiment, and as such may be altered or adapted to vary from that depicted here in other embodiments.

The beverage preparation apparatus 200 further comprises an injection needle 206, which is disposed such that, when the capsule holder 202 is disposed in position to produce a beverage, it will pierce the first membrane 110 and protrude into the beverage capsule 100. In this way, a volume of water under pressure can be injected into the beverage capsule 100.

Of course, water-injecting means other than an injection needle may be envisioned in other embodiments.

It will be noted that the provision of the partition 114 facilitates this injection. First, it will be noted that the partition can be advantageously positioned such that it creates a gutter, in the space between the partition and the capsule body. This is apparent in FIG. 2, wherein it can be seen that a gutter 208 is formed between the capsule body 102 and the partition 114.

This gutter is advantageous, in that when the water is injected into the beverage capsule 100 via the injection needle 206, it will not impinge directly on the beverage ingredient but instead fall in the gutter 208.

The gutter 208 will subsequently fill with water until it reaches the level of the face 119, at which point it will overflow into the channels 128 and enter the chamber 117, mix with the beverage ingredient 120, and produce a beverage. In this way, an even distribution of the flow of water across the cross-section of the beverage ingredient 120 is realized.

Moreover, as water is incompressible, the presence of water in the gutter 208 during the extraction of a beverage serves as a structural reinforcement of the partition 114 against pressure within. Thus, the maximum pressure at which the beverage is extracted may be increased without running the risk of creating a pressure differential across the partition 114 and exerting a strain on the mass of beverage ingredient 120.

In this way, the structural integrity of the beverage ingredient 120 is maintained, thereby avoiding the formation of cracks therein that may induce channeled flow, and consequently diminish the quality of the beverage produced due to the uneven extraction that results from said channeled flow.

It will be noted that, in order for the beverage to be drained from the beverage capsule, there must be some sort of opening in the second end of the beverage capsule to permit the beverage to drain therefrom. It may therefore be advantageous to provide a means for breaching the second membrane 124 during the preparation of a beverage. To this end, there is provided in the capsule receptacle 202 a breaching element 210, which is complementary to the beverage capsule 100. In this embodiment, the breaching element 210 is constituted by a plurality of pyramid-shaped projections 212 in the capsule receptacle 202. When the water is injected into the beverage capsule 100 through the injection needle 206, the pressure within the beverage capsule 100 will rise, causing the second membrane 124 to deflect outwards.

As a result of this outward deflection, the second membrane 124 comes into contact with the pyramid-shaped projections 212 disposed in the capsule receptacle 202. This causes the second membrane 124 to rupture along with the opening mechanisms described in preamble of the present specification, thereby furnishing an outlet from which the beverage can flow from the beverage capsule 100.

It should be noted that the dimensions of the capsule receptacle 202 and the breaching element 210 as depicted in FIG. 2 are exaggerated for clarity; in particular, the spacing between the second membrane 124 and the pyramid-shaped projections 212 is not necessarily as great as that depicted here. Indeed, the form of the capsule receptacle 202 and the breaching element 210 in FIG. 2 should be considered as merely representative, and may be adapted as necessary for any particular application.

The breaching element, it will be understood, need not necessarily be a plurality of pyramid-shaped projections as depicted here. Rather, it may instead be simply a single projection (e.g. a needle or a spike), a blade, or some other means for rupturing the second membrane of the beverage capsule in a clean and predictable manner. Nonetheless, it will be noted that pyramid-shaped projections are advantageous in that they are relatively easy to fabricate, resistant to dulling over use, and less likely to cause injury when brought into contact with skin than a blade or needle.

It will be noted that in FIG. 2, the pyramid-shaped projections 212 are integrated into the capsule receptacle 202. In other embodiments, it may instead be preferable to provide the breaching element as a unit that is separate from the beverage capsule 100. This is advantageous in certain applications; for example, the breaching element may be made permanent or semi-permanent, being removed from the capsule receptacle 202 only for periodic cleaning.

Alternatively, the breaching element may be made to attach permanently to the beverage capsule; such a breaching element will be assembled to the beverage capsule after the beverage capsule has been completely filled and sealed, and is thus configured to be used only once. This attachment may be made with simple, inexpensive means such as a friction fit, a layer of adhesive, or thermal or ultrasonic welding. Alternatively, more complex structures such as snaps, clips, screw threads, or other such mechanisms or structures which may be deemed appropriate for certain implementations.

The person of skill in the art will therefore be readily capable of determining exactly how to configure the capsule and the complementary breaching element for any particular application.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A capsule for a beverage-preparation apparatus, the capsule comprising:

a substantially cup-shaped capsule body defining a cavity and comprising a first end face adapted to cooperate with a water injector of the beverage-preparation apparatus;

a substantially cup-shaped partition extending into the cavity from a second end face of the substantially cup-shaped capsule body opposite the first end face, a space being thereby formed between the substantially cup-shaped partition and the first end face, the substantially cup-shaped partition defining with the second end face a chamber within which a quantity of a beverage ingredient is located, wherein the beverage ingredient is only in the chamber defined by the substantially cup-shaped partition, the first end face comprises a first opening and further comprises a first membrane disposed upon the first opening to seal the first opening, and the second end face comprises a second opening and further comprises a second membrane disposed upon the second opening to seal the second opening; and a fluid communication member located in and establishing fluid communication across the substantially cup-shaped partition.

2. The capsule according to claim 1, wherein the chamber is configured to communicate with the second opening in the second end face of the capsule, the second membrane being sealed to the second opening.

3. The capsule according to claim 1, wherein the beverage ingredient is compressed into the chamber defined by the partition and the second end face.

4. The capsule according to claim 1, wherein the fluid communication member is located in the substantially cup-shaped partition proximate to the first end face and opposite the second end face of the capsule.

5. The capsule according to claim 1, wherein the fluid communication member comprises a plurality of perforations uniformly distributed across a surface of the substantially cup-shaped partition.

6. The capsule according to claim 1, wherein the substantially cup-shaped partition is located centrally within the substantially cup-shaped capsule body, an annular gutter being formed between the substantially cup-shaped partition and the substantially cup-shaped capsule body.

7. The capsule according to claim 1, wherein the substantially cup-shaped partition has a cylindrical or frusto-conical form.

8. The capsule according to claim 1, wherein the volume of the chamber is between 10 $cm^3$ and 15 $cm^3$.

9. The capsule according to claim 1, wherein the substantially cup-shaped capsule body and the substantially cup-shaped partition are formed as a single piece.

10. The capsule according to claim 1, wherein the substantially cup-shaped capsule body and the substantially cup-shaped partition are formed separately and assembled together.

11. The capsule according to claim 1, wherein the first end face has a larger diameter than the second end face.

12. The capsule according to claim 1, wherein the first membrane is sealed to a rim of the capsule at the first end face.

* * * * *